US007987089B2

(12) United States Patent
Krishnan et al.

(10) Patent No.: US 7,987,089 B2
(45) Date of Patent: Jul. 26, 2011

(54) SYSTEMS AND METHODS FOR MODIFYING A ZERO PAD REGION OF A WINDOWED FRAME OF AN AUDIO SIGNAL

(75) Inventors: Venkatesh Krishnan, San Diego, CA (US); Ananthapadmanabhan A. Kandhadai, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 777 days.

(21) Appl. No.: 11/674,745

(22) Filed: Feb. 14, 2007

(65) Prior Publication Data

US 2008/0027719 A1 Jan. 31, 2008

Related U.S. Application Data

(60) Provisional application No. 60/834,674, filed on Jul. 31, 2006.

(51) Int. Cl.
*G10L 11/06* (2006.01)

(52) U.S. Cl. ..... 704/214; 704/208

(58) Field of Classification Search ..... 704/214, 704/208

See application file for complete search history.

(56) References Cited

U.S. PATENT DOCUMENTS

| | | | | |
|---|---|---|---|---|
| 5,357,594 | A * | 10/1994 | Fielder | 704/200.1 |
| 5,363,096 | A * | 11/1994 | Duhamel et al. | 341/50 |
| 5,384,891 | A * | 1/1995 | Asakawa et al. | 704/220 |
| 5,394,473 | A * | 2/1995 | Davidson | 704/200.1 |
| 5,455,888 | A | 10/1995 | Iyengar et al. | |
| 5,704,003 | A | 12/1997 | Kleijn et al. | |
| 5,978,759 | A | 11/1999 | Tsushima et al. | |
| 6,134,518 | A | 10/2000 | Cohen et al. | |
| 6,654,716 | B2 * | 11/2003 | Bruhn et al. | 704/219 |
| 6,879,955 | B2 | 4/2005 | Rao | |
| 7,116,745 | B2 * | 10/2006 | Fanson et al. | 375/371 |
| 7,136,418 | B2 * | 11/2006 | Atlas et al. | 375/242 |
| 7,461,002 | B2 * | 12/2008 | Crockett et al. | 704/278 |
| 7,516,064 | B2 * | 4/2009 | Vinton et al. | 704/206 |
| 2003/0009325 | A1 * | 1/2003 | Kirchherr et al. | 704/211 |
| 2003/0167165 | A1 * | 9/2003 | Schroder et al. | 704/212 |

(Continued)

FOREIGN PATENT DOCUMENTS

EP 1089258 A2 4/2001

(Continued)

OTHER PUBLICATIONS

Chen, T. "Multimedia Systems, Standards, and Networks." Marcell Dekker, Inc. New York, 2000. p. 137-138.*

(Continued)

*Primary Examiner* — Talivaldis Ivars Smits
*Assistant Examiner* — Shaun Roberts
(74) *Attorney, Agent, or Firm* — Anthony P. Mauro

(57) ABSTRACT

A method for modifying a window with a frame associated with an audio signal is described. A signal is received. The signal is partitioned into a plurality of frames. A determination is made if a frame within the plurality of frames is associated with a non-speech signal. A modified discrete cosine transform (MDCT) window function is applied to the frame to generate a first zero pad region, where the region has a length of (M–L)/2, where L is an arbitrary value, and a second zero pad region if it was determined that the frame is associated with a non-speech signal. The frame is encoded. The decoder window is the same as the encoder window.

23 Claims, 12 Drawing Sheets

U.S. PATENT DOCUMENTS

| | | | | |
|---|---|---|---|---|
| 2004/0098255 | A1 | 5/2004 | Kovesi et al. | |
| 2006/0271356 | A1 | 11/2006 | Vos | |
| 2006/0277038 | A1 | 12/2006 | Vos et al. | |
| 2006/0277042 | A1 | 12/2006 | Vos et al. | |
| 2006/0282263 | A1 | 12/2006 | Vos et al. | |
| 2007/0088541 | A1 | 4/2007 | Vos et al. | |
| 2007/0088542 | A1 | 4/2007 | Vos et al. | |
| 2007/0088558 | A1 | 4/2007 | Vos et al. | |
| 2007/0150271 | A1 * | 6/2007 | Virette et al. | 704/230 |

FOREIGN PATENT DOCUMENTS

| | | | |
|---|---|---|---|
| EP | 1278184 | A2 | 1/2003 |
| EP | 1126620 | B1 | 12/2005 |
| EP | 1793372 | | 6/2007 |
| JP | 06268608 | | 9/1994 |
| RU | 2364958 | | 8/2009 |
| WO | WO2006046546 | | 5/2006 |

OTHER PUBLICATIONS

Bessette, B. et al., "The Adaptive Multirate Wideband Speech Codec (AMR-WB)," IEEE Trans. on Speech and Audio Processing, 10(8): 620-636, Nov. 2002.

Nilsson, M. et al., "Gaussian Mixture Model based Mutual Information Estimation between Frequency Based in Speech," Proc. IEEE Int. Conf. on Acoustic Speech and Signal Processing, Florida, 2002, pp. 525-528.

McCree, A., "A 14 kb/s Wideband Speech Coder With a Parametric Highband Model," Int. Conf. on Acoustic Speech and Signal Processing, Turkey, 2000, pp. 1153-1156.

Makhoul, J. & Berouti, M., "High Frequency Regeneration In Speech Coding Systems," Proc. IEEE Int. Conf. on Acoustic Speech and Signal Processing, Washington, 1979, pp. 428-431.

Valin, J.-M. & Lefebvre, R., "Bandwidth Extension of Narrowband Speech for Low Bit-Rate Wideband Coding," Proc. IEEE Speech Coding Workshop (SCW), 2000, pp. 130-132.

Knagenhjelm, P.H. & Kleijn W.B., "Spectral dynamics is more important than spectral distortion," Proc. IEEE Int. Conf. on Acoustic Speech and Signal Processing, 1995, pp. 732-735.

Baumgarte, F. et al. "Binaural Cue Coding-Part II:Schemes and applications" IEEE Transactions on Speech and Audio Processing, IEEE Service Center, New York, NY, US, vol . 11, No. 6, Nov. 2003, pp. 520-531, XP011104739.

International Search Report and Written Opinion—PCT/US2007/074898, International Search Authority—European Patent Office—Dec. 27, 2007.

Iwadare, M. et al: "A 128 KB/s Hi-Fl Audio CODEC Based On Adaptive Transform Coding With Adaptive Block Size MDCT" IEEE Journal on Selected Areas in Communications, IEEE Service Center, Piscataway, NJ, US, vol . 10, No. 1, Jan. 1992, pp. 138-144, XP000462072.

* cited by examiner

SYSTEMS AND METHODS FOR MODIFYING A ZERO PAD REGION OF A WINDOWED FRAME OF AN AUDIO SIGNAL

CLAIM OF PRIORITY UNDER 35 U.S.C. §119

This present Application for Patent claims priority to Provisional Application No. 60/834,674 entitled "Windowing for Perfect Reconstruction in MDCT with Less than 50% Frame Overlap" filed Jul. 31, 2006, and assigned to the assignee hereof and hereby expressly incorporated by reference herein.

TECHNICAL FIELD

The present systems and methods relates generally to speech processing technology. More specifically, the present systems and methods relate to modifying a window with a frame associated with an audio signal.

BACKGROUND

Transmission of voice by digital techniques has become widespread, particularly in long distance, digital radio telephone applications, video messaging using computers, etc. This, in turn, has created interest in determining the least amount of information that can be sent over a channel while maintaining the perceived quality of the reconstructed speech. Devices for compressing speech find use in many fields of telecommunications. One example of telecommunications is wireless communications. Another example is communications over a computer network, such as the Internet. The field of communications has many applications including, e.g., computers, laptops, personal digital assistants (PDAs), cordless telephones, pagers, wireless local loops, wireless telephony such as cellular and portable communication system (PCS) telephone systems, mobile Internet Protocol (IP) telephony and satellite communication systems.

DETAILED DESCRIPTION

Figure 1:
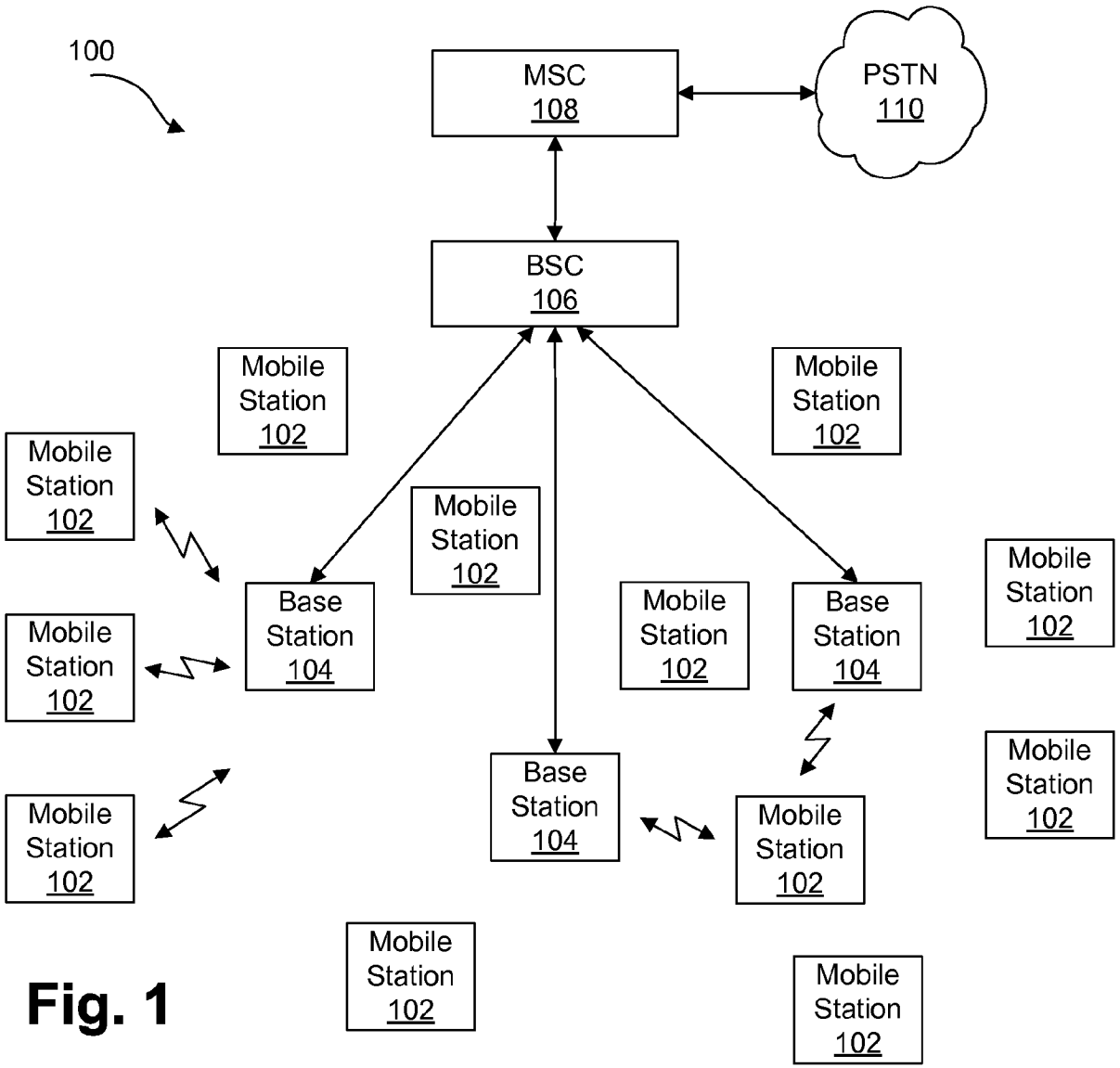
FIG. 1 illustrates one configuration of a wireless communication system.

A method for modifying a window with a frame associated with an audio signal is described. A signal is received. The signal is partitioned into a plurality of frames. A determination is made if a frame within the plurality of frames is associated with a non-speech signal. A modified discrete cosine transform (MDCT) window function is applied to the frame to generate a first zero pad region and a second zero pad region if it was determined that the frame is associated with a non-speech signal. The frame is encoded.

An apparatus for modifying a window with a frame associated with an audio signal is also described. The apparatus includes a processor and memory in electronic communication with the processor. Instructions are stored in the memory. The instructions are executable to: receive a signal; partition the signal into a plurality of frames; determine if a frame within the plurality of frames is associated with a non-speech signal; apply a modified discrete cosine transform (MDCT) window function to the frame to generate a first zero pad region and a second zero pad region if it was determined that the frame is associated with a non-speech signal; and encode the frame.

A system that is configured to modify a window with a frame associated with an audio signal is also described. The system includes a means for processing and a means for receiving a signal. The system also includes a means for partitioning the signal into a plurality of frames and a means for determining if a frame within the plurality of frames is associated with a non-speech signal. The system further includes a means for applying a modified discrete cosine transform (MDCT) window function to the frame to generate a first zero pad region and a second zero pad region if it was determined that the frame is associated with a non-speech signal and a means for encoding the frame.

A computer-readable medium configured to store a set of instructions is also described. The instructions are executable to: receive a signal; partition the signal into a plurality of frames; determine if a frame within the plurality of frames is associated with a non-speech signal; apply a modified discrete cosine transform (MDCT) window function to the frame to generate a first zero pad region and a second zero pad region if it was determined that the frame is associated with a non-speech signal; and encode the frame.

A method for selecting a window function to be used in calculating a modified discrete cosine transform (MDCT) of a frame is also described. An algorithm for selecting a window function to be used in calculating an MDCT of a frame is provided. The selected window function is applied to the frame. The frame is encoded with an MDCT coding mode based on constraints imposed on the MDCT coding mode by additional coding modes, wherein the constraints comprise a length of the frame, a look ahead length and a delay.

A method for reconstructing an encoded frame of an audio signal is also described. A packet is received. The packet is disassembled to retrieve an encoded frame. Samples of the frame that are located between a first zero pad region and a first region are synthesized. An overlap region of a first length is added with a look-ahead length of a previous frame. A look-ahead of the first length of the frame is stored. A reconstructed frame is outputted.

Various configurations of the systems and methods are now described with reference to the Figures, where like reference numbers indicate identical or functionally similar elements. The features of the present systems and methods, as generally described and illustrated in the Figures herein, could be arranged and designed in a wide variety of different configurations. Thus, the detailed description below is not intended to limit the scope of the systems and methods, as claimed, but is merely representative of the configurations of the systems and methods.

Many features of the configurations disclosed herein may be implemented as computer software, electronic hardware, or combinations of both. To clearly illustrate this interchangeability of hardware and software, various components will be described generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present systems and methods.

Where the described functionality is implemented as computer software, such software may include any type of computer instruction or computer executable code located within a memory device and/or transmitted as electronic signals over a system bus or network. Software that implements the functionality associated with components described herein may comprise a single instruction, or many instructions, and may be distributed over several different code segments, among different programs, and across several memory devices.

As used herein, the terms "a configuration," "configuration," "configurations," "the configuration," "the configurations," "one or more configurations," "some configurations," "certain configurations," "one configuration," "another configuration" and the like mean "one or more (but not necessarily all) configurations of the disclosed systems and methods," unless expressly specified otherwise.

The term "determining" (and grammatical variants thereof) is used in an extremely broad sense. The term "determining" encompasses a wide variety of actions and therefore "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing, and the like.

The phrase "based on" does not mean "based only on," unless expressly specified otherwise. In other words, the phrase "based on" describes both "based only on" and "based at least on." In general, the phrase, "audio signal" may be used to refer to a signal that may be heard. Examples of audio signals may include representing human speech, instrumental and vocal music, tonal sounds, etc.

FIG. 1 illustrates a code-division multiple access (CDMA) wireless telephone system 100 that may include a plurality of mobile stations 102, a plurality of base stations 104, a base station controller (BSC) 106 and a mobile switching center (MSC) 108. The MSC 108 may be configured to interface with a public switch telephone network (PSTN) 110. The MSC 108 may also be configured to interface with the BSC 106. There may be more than one BSC 106 in the system 100. Each base station 104 may include at least one sector (not shown), where each sector may have an omnidirectional antenna or an antenna pointed in a particular direction radially away from the base stations 104. Alternatively, each sector may include two antennas for diversity reception. Each base station 104 may be designed to support a plurality of frequency assignments. The intersection of a sector and a frequency assignment may be referred to as a CDMA channel. The mobile stations 102 may include cellular or portable communication system (PCS) telephones.

During operation of the cellular telephone system 100, the base stations 104 may receive sets of reverse link signals from sets of mobile stations 102. The mobile stations 102 may be conducting telephone calls or other communications. Each reverse link signal received by a given base station 104 may be processed within that base station 104. The resulting data may be forwarded to the BSC 106. The BSC 106 may provide call resource allocation and mobility management functionality including the orchestration of soft handoffs between base stations 104. The BSC 106 may also route the received data to the MSC 108, which provides additional routing services for interface with the PSTN 110. Similarly, the PSTN 18 may interface with the MSC 108, and the MSC 108 may interface with the BSC 106, which in turn may control the base stations 104 to transmit sets of forward link signals to sets of mobile stations 102.

Figure 2:
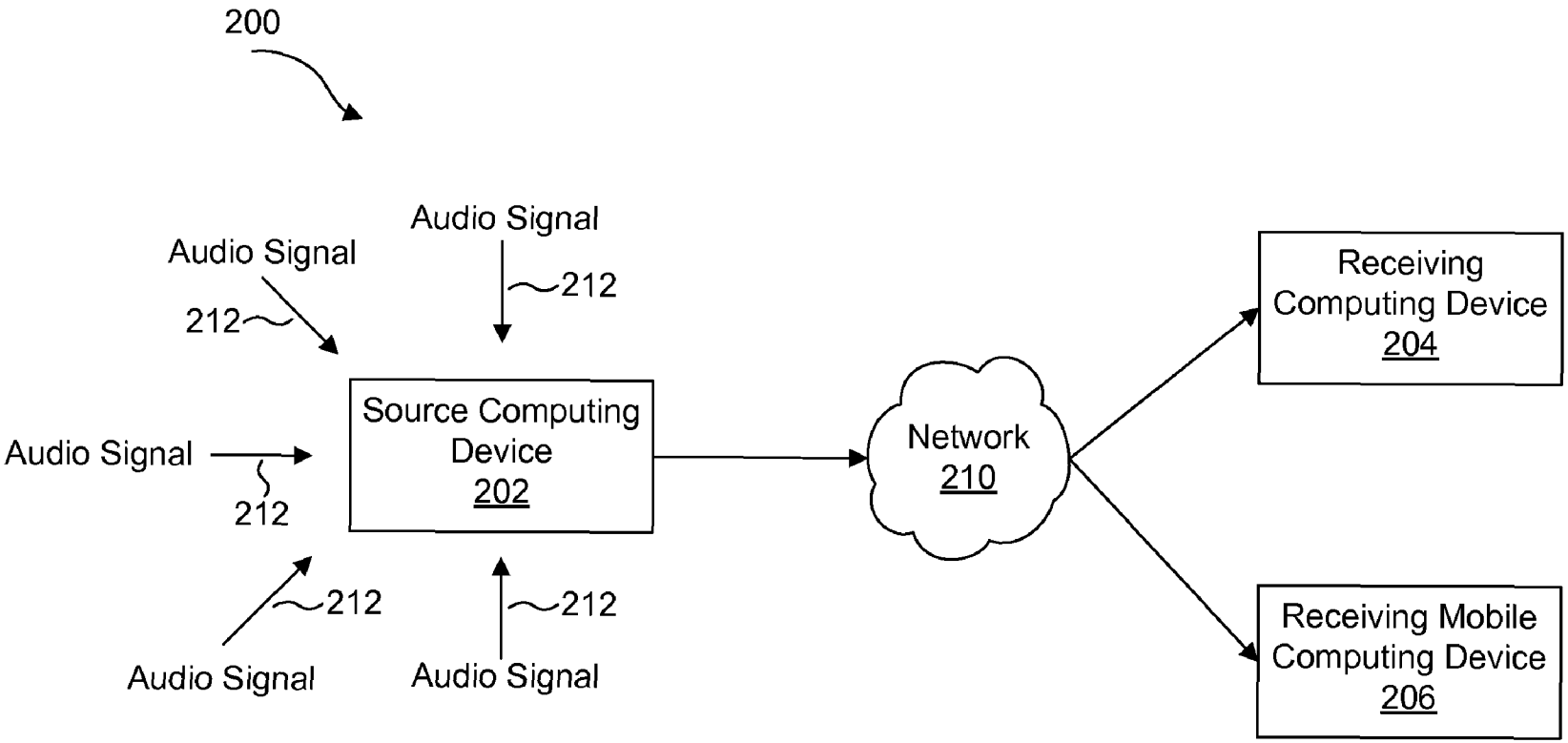
FIG. 2 is a block diagram illustrating one configuration of a computing environment.

FIG. 2 depicts one configuration of a computing environment 200 including a source computing device 202, a receiving computing device 204 and a receiving mobile computing device 206. The source computing device 202 may communicate with the receiving computing devices 204, 206 over a network 210. The network 210 may a type of computing network including, but not limited to, the Internet, a local area network (LAN), a campus area network (CAN), a metropolitan area network (MAN), a wide area network (WAN), a ring network, a star network, a token ring network, etc.

In one configuration, the source computing device 202 may encode and transmit audio signals 212 to the receiving computing devices 204, 206 over the network 210. The audio signals 212 may include speech signals, music signals, tones, background noise signals, etc. As used herein, "speech signals" may refer to signals generated by a human speech system and "non-speech signals" may refer to signals not generated by the human speech system (i.e., music, background noise, etc.). The source computing device 202 may be a mobile phone, a personal digital assistant (PDA), a laptop computer, a personal computer or any other computing device with a processor. The receiving computing device 204 may be a personal computer, a telephone, etc. The receiving mobile computing device 206 may be a mobile phone, a PDA, a laptop computer or any other mobile computing device with a processor.

Figure 3:
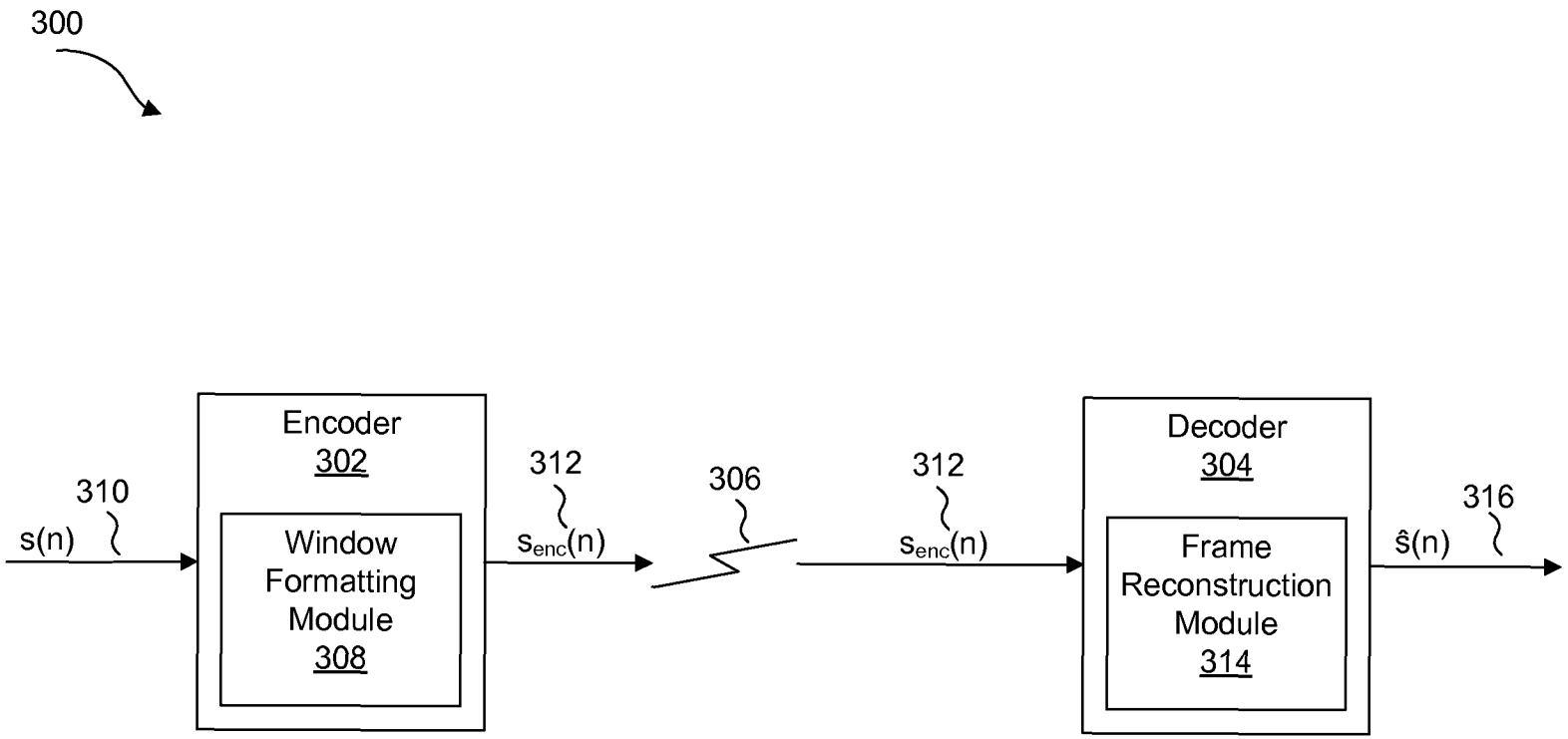
FIG. 3 is a block diagram illustrating one configuration of a signal transmission environment.

FIG. 3 depicts a signal transmission environment 300 including an encoder 302, a decoder 304 and a transmission medium 306. The encoder 302 may be implemented within a mobile station 102 or a source computing device 202. The decoder 304 may be implemented in a base station 104, in the mobile station 102, in a receiving computing device 204 or in a receiving mobile computing device 206. The encoder 302 may encode an audio signal s(n) 310, forming an encoded audio signal $s_{enc}(n)$ 312. The encoded audio signal 312 may be transmitted across the transmission medium 306 to the decoder 304. The transmission medium 306 may facilitate the encoder 302 to transmit an encoded audio signal 312 to the decoder wirelessly or it may facilitate the encoder 302 to transmit the encoded signal 312 over a wired connection between the encoder 302 and the decoder 304. The decoder 304 may decode $s_{enc}(n)$ 312, thereby generating a synthesized audio signal $\hat{s}(n)$ 316.

The term "coding" as used herein may refer generally to methods encompassing both encoding and decoding. Generally, coding systems, methods and apparatuses seek to minimize the number of bits transmitted via the transmission medium 306 (i.e., minimize the bandwidth of $s_{enc}(n)$ 312) while maintaining acceptable signal reproduction (i.e., s(n) 310≈ŝ(n) 316). The composition of the encoded audio signal 312 may vary according to the particular audio coding mode utilized by the encoder 302. Various coding modes are described below.

The components of the encoder 302 and the decoder 304 described below may be implemented as electronic hardware, as computer software, or combinations of both. These components are described below in terms of their functionality. Whether the functionality is implemented as hardware or software may depend upon the particular application and design constraints imposed on the overall system. The transmission medium 306 may represent many different transmission media, including, but not limited to, a land-based communication line, a link between a base station and a satellite, wireless communication between a cellular telephone and a base station, between a cellular telephone and a satellite or communications between computing devices.

Each party to a communication may transmit data as well as receive data. Each party may utilize an encoder 302 and a decoder 304. However, the signal transmission environment 300 will be described below as including the encoder 302 at one end of the transmission medium 306 and the decoder 304 at the other.

In one configuration, s(n) 310 may include a digital speech signal obtained during a typical conversation including different vocal sounds and periods of silence. The speech signal s(n) 310 may be partitioned into frames, and each frame may be further partitioned into subframes. These arbitrarily chosen frame/subframe boundaries may be used where some block processing is performed. Operations described as being performed on frames might also be performed on subframes, in this sense; frame and subframe are used interchangeably herein. Also, one or more frame may be included in a window which may illustrate the placement and timing between various frames.

In another configuration, s(n) 310 may include a non-speech signal, such as a music signal. The non-speech signal may be partitioned into frames. One or more frames may be included in a window which may illustrate the placement and timing between various frames. The selection of the window may depend on coding techniques implemented to encode the signal and delay constraints that may be imposed on the system. The present systems and methods describe a method for selecting a window shape employed in encoding and decoding non-speech signals with a modified discrete cosine transform (MDCT) and an inverse modified discrete cosine transform (IMDCT) based coding technique in a system that is capable of coding both speech and non-speech signals. The system may impose constraints on how much frame delay and look ahead may be used by the MDCT based coder to enable generation of encoded information at a uniform rate.

In one configuration, the encoder 302 includes a window formatting module 308 which may format the window which includes frames associated with non-speech signals. The frames included in the formatted window may be encoded and the decoder may reconstruct the coded frames by implementing a frame reconstruction module 314. The frame reconstruction module 314 may synthesize the coded frames such that the frames resemble the pre-coded frames of the speech signal 310.

Figure 4A:
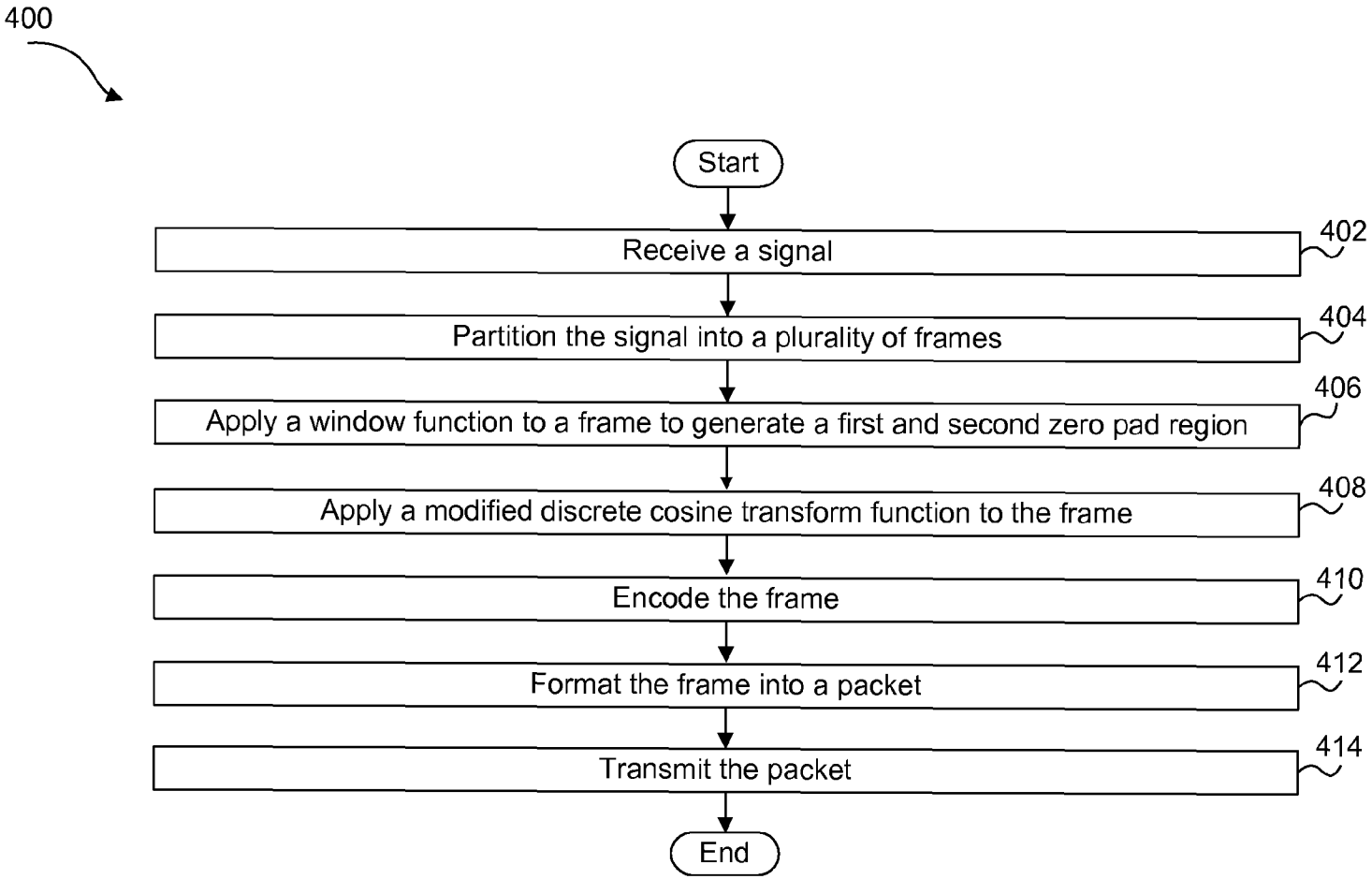
FIG. 4A is a flow diagram illustrating one configuration of a method for modifying a window with a frame associated with an audio signal.

FIG. 4 is a flow diagram illustrating one configuration of a method 400 for modifying a window with a frame associated with an audio signal. The method 400 may be implemented by the encoder 302. In one configuration, a signal is received 402. The signal may be an audio signal as previously described. The signal may be partitioned 404 into a plurality of frames. A window function may be applied 408 to generate a window and a first zero-pad region and a second zero-pad region may be generated as a part of the window for calculating a modified discrete cosine transform (MDCT). In other words, the value of the beginning and end portions of the window may be zero. In one aspect, the length of the first zero-pad region and the length of the second zero-pad region may be a function of delay constraints of the encoder 302.

The modified discrete cosine transform (MDCT) function may be used in several audio coding standards to transform pulse-code modulation (PCM) signal samples, or their processed versions, into their equivalent frequency domain representation. The MDCT may be similar to a type IV Discrete Cosine Transform (DCT) with the additional property of frames overlapping one another. In other words, consecutive frames of a signal that are transformed by the MDCT may overlap each other by 50%.

Additionally, for each frame of 2M samples, the MDCT may produce M transform coefficients. The MDCT may be a critically sampled perfect reconstruction filter bank. In order to provide perfect reconstruction, the MDCT coefficients X(k), for k=0, 1, . . . M, obtained from a frame of signal x(n), for n=0, 1 . . . 2M, may be given by $$X(k) = \sum_{n=0}^{2M-1} x(n)h_k(n) \tag{1}$$

where $$h_k(n) = w(n)\sqrt{\frac{2}{M}}\cos\left[\frac{(2n+M+1)(2k+1)\pi}{4M}\right] \tag{2}$$

for k=0, 1, . . . , M, and w(n) is a window that may satisfy the Princen-Bradley condition, which states:

$$w^2(n)+w^2(n+M)=1 \tag{3}$$

At the decoder, the M coded coefficients may be transformed back to the time domain using an inverse MDCT (IMDCT). If $\hat{X}(k)$, for k=0, 1, 2 . . . M are the received MDCT coefficients, then the corresponding IMDCT decoder generates the reconstructed audio signal by first taking the IMDCT of the received coefficients to obtain 2M samples according to $$\hat{x}(n) = \sum_{k=0}^{M-1} \hat{X}(k)h_k(n) \text{ for } n = 0, 1, \ldots, 2M-1 \tag{4}$$

where $h_k(n)$ is defined by equation (2), then overlapping and adding the first M samples of the present frame with the M last samples of the previous frame's IMDCT output and first M samples from the next frame's IMDCT output. Thus, if the decoded MDCT coefficients corresponding to the next frame are not available at a given time, only M audio samples of the present frame may be completely reconstructed.

Figure 4B:
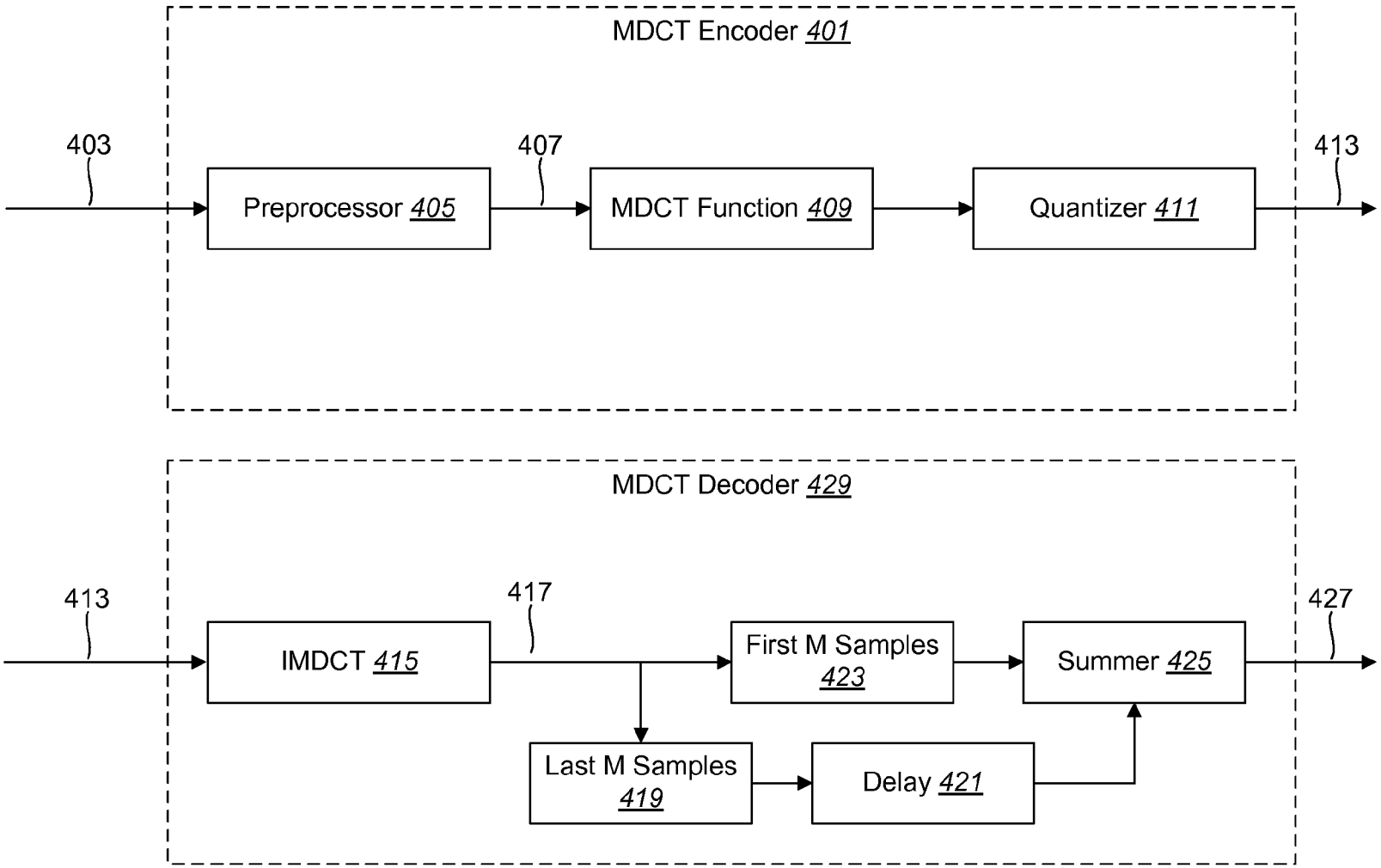
FIG. 4B is a block diagram illustrating a configuration of an encoder for modifying the window with the frame associated with the audio signal and a decoder.

The MDCT system may utilize a look-ahead of M samples. The MDCT system may include an encoder which obtains the MDCT of either the audio signal or filtered versions of it using a predetermined window and a decoder that includes an IMDCT function that uses the same window that the encoder uses. The MDCT system may also include an overlap and an add module. For example, FIG. 4B illustrates a MDCT encoder 401. An input audio signal 403 is received by a preprocessor 405. The preprocessor 405 implements preprocessing, linear predictive coding (LPC) filtering and other types of filtering. A processed audio signal 407 is produced from the preprocessor 405. An MDCT function 409 is applied on 2M signal samples that have been appropriately windowed. In one configuration, a quantizer 411 quantizes and encodes M coefficients 413 and the M coded coefficients are transmitted to an MDCT decoder 429.

The decoder 429 receives M coded coefficients 413. An IMDCT 415 is applied on the M received coefficients 413 using the same window as in the encoder 401. 2M signal values 417 may be categorized as first M samples selection 423 and last M samples 419 may be saved. The last M samples 419 may further be delayed one frame by a delay 421. The first M samples 423 and the delayed last M samples 419 may be summed by a summer 425. The summed samples may be used to produce a reconstructed M samples 427 of the audio signal.

Typically, in MDCT systems, 2M signals may be derived from M samples of a present frame and M samples of a future frame. However, if only L samples from the future frame are available, a window may be selected that implements L samples of the future frame.

In a real-time voice communication system operating over a circuit switched network, the length of the look-ahead samples may be constrained by the maximum allowable encoding delay. It may be assumed that a look-ahead length of L is available. L may be less than or equal to M. Under this condition, it may still be desirable to use the MDCT, with the overlap between consecutive frames being L samples, while preserving the perfect reconstruction property.

The present systems and methods may be relevant particularly for real time two way communication systems where an encoder is expected to generate information for transmission at a regular interval regardless of the choice of a coding mode. The system may not be capable of tolerating jitter in the generation of such information by the encoder or such a jitter in the generation of such information may not be desired.

In one configuration, a modified discrete cosine transform (MDCT) function is applied 410 to the frame. Applying the window function may be a step in calculating an MDCT of the frame. In one configuration, the MDCT function processes 2M input samples to generate M coefficients that may then be quantized and transmitted.

In one configuration, the frame may be encoded 412. In one aspect, the coefficients of the frame may be encoded 412. The frame may be encoded using various encoding modes which will be more fully discussed below. The frame may be formatted 414 into a packet and the packet may be transmitted 416. In one configuration, the packet is transmitted 416 to a decoder.

Figure 5:
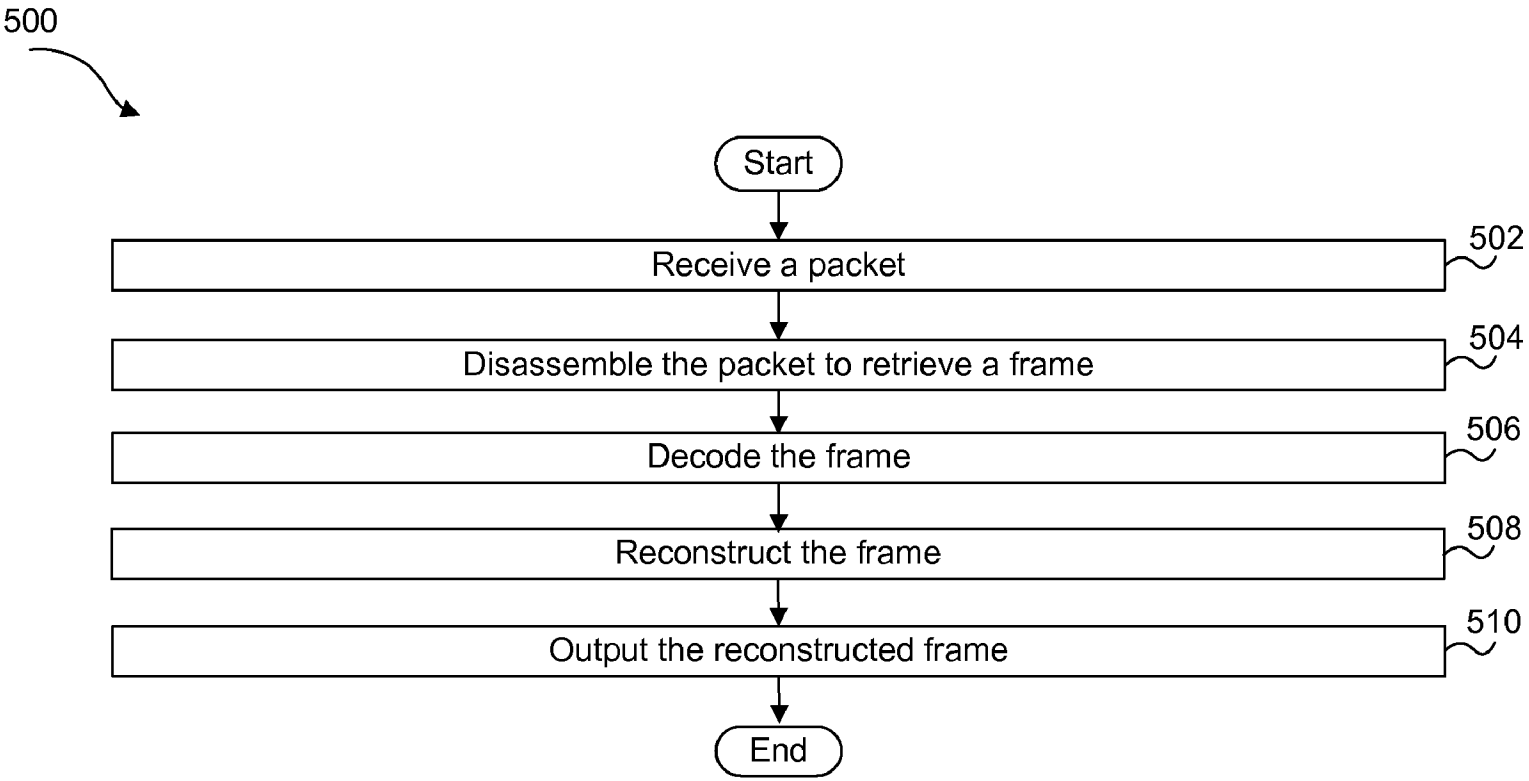
FIG. 5 is a flow diagram illustrating one configuration of a method for reconstructing an encoded frame of an audio signal.

FIG. 5 is a flow diagram illustrating one configuration of a method 500 for reconstructing an encoded frame of an audio signal. In one configuration, the method 500 may be implemented by the decoder 304. A packet may be received 502. The packet may be received 502 from the encoder 302. The packet may be disassembled 504 in order to retrieve a frame. In one configuration, the frame may be decoded 506. The frame may be reconstructed 508. In one example, the frame reconstruction module 314 reconstructs the frame to resemble the pre-encoded frame of the audio signal. The reconstructed frame may be outputted 510. The outputted frame may be combined with additional outputted frames to reproduce the audio signal.

Figure 6:
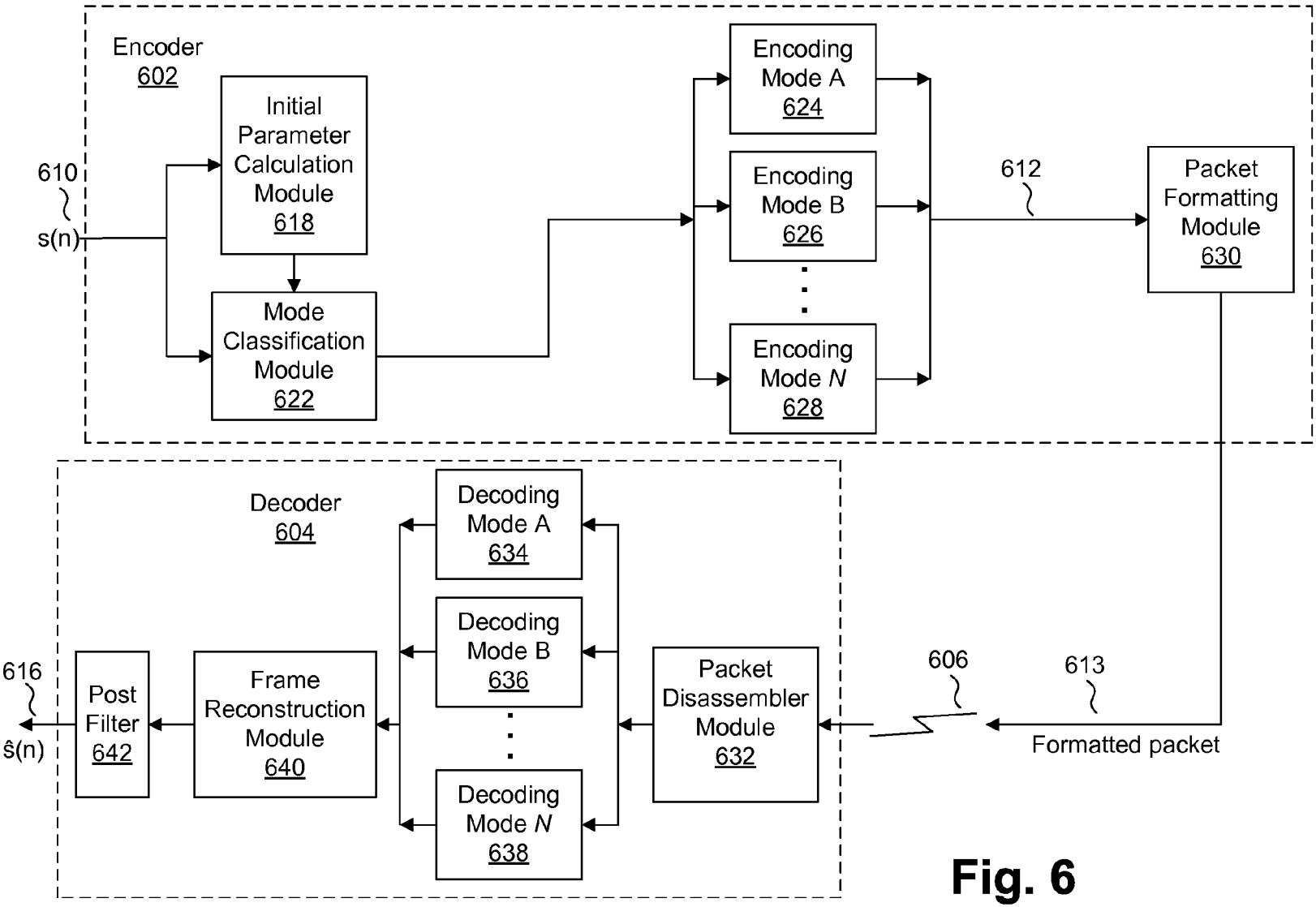
FIG. 6 is a block diagram illustrating one configuration of a multi-mode encoder communicating with a multi-mode decoder.

FIG. 6 is a block diagram illustrating one configuration of a multi-mode encoder 602 communicating with a multi-mode decoder 604 across a communications channel 606. A system that includes the multi-mode encoder 602 and the multi-mode decoder 604 may be an encoding system that includes several different coding schemes to encode different audio signal types. The communication channel 606 may include a radio frequency (RF) interface. The encoder 602 may include an associated decoder (not shown). The encoder 602 and its associated decoder may form a first coder. The decoder 604 may include an associated encoder (not shown). The decoder 604 and its associated encoder may form a second coder.

The encoder 602 may include an initial parameter calculation module 618, a mode classification module 622, a plurality of encoding modes 624, 626, 628 and a packet formatting module 630. The number of encoding modes 624, 626, 628 is shown as N, which may signify any number of encoding modes 624, 626, 628. For simplicity, three encoding modes 624, 626, 628 are shown, with a dotted line indicating the existence of other encoding modes.

The decoder 604 may include a packet disassembler module 632, a plurality of decoding modes 634, 636, 638, a frame reconstruction module 640 and a post filter 642. The number of decoding modes 634, 636, 638 is shown as N, which may signify any number of decoding modes 634, 636, 638. For simplicity, three decoding modes 634, 636, 638 are shown, with a dotted line indicating the existence of other decoding modes.

An audio signal, s(n) 610, may be provided to the initial parameter calculation module 618 and the mode classification module 622. The signal 610 may be divided into blocks of samples referred to as frames. The value n may designate the frame number or the value n may designate a sample number in a frame. In an alternate configuration, a linear prediction (LP) residual error signal may be used in place of the audio signal 610. The LP residual error signal may be used by speech coders such as a code excited linear prediction (CELP) coder.

The initial parameter calculation module 618 may derive various parameters based on the current frame. In one aspect, these parameters include at least one of the following: linear predictive coding (LPC) filter coefficients, line spectral pair (LSP) coefficients, normalized autocorrelation functions (NACFs), open-loop lag, zero crossing rates, band energies, and the formant residual signal. In another aspect, the initial parameter calculation module 618 may preprocess the signal 610 by filtering the signal 610, calculating pitch, etc.

The initial parameter calculation module 618 may be coupled to the mode classification module 622. The mode classification module 622 may dynamically switch between the encoding modes 624, 626, 628. The initial parameter calculation module 618 may provide parameters to the mode classification module 622 regarding the current frame. The mode classification module 622 may be coupled to dynamically switch between the encoding modes 624, 626, 628 on a frame-by-frame basis in order to select an appropriate encoding mode 624, 626, 628 for the current frame. The mode classification module 622 may select a particular encoding mode 624, 626, 628 for the current frame by comparing the parameters with predefined threshold and/or ceiling values. For example, a frame associated with a non-speech signal may be encoded using MDCT coding schemes. An MDCT coding scheme may receive a frame and apply a specific MDCT window format to the frame. An example of the specific MDCT window format is described below in relation to FIG. 8.

The mode classification module 622 may classify a speech frame as speech or inactive speech (e.g., silence, background noise, or pauses between words). Based upon the periodicity of the frame, the mode classification module 622 may classify speech frames as a particular type of speech, e.g., voiced, unvoiced, or transient.

Voiced speech may include speech that exhibits a relatively high degree of periodicity. A pitch period may be a component of a speech frame that may be used to analyze and reconstruct the contents of the frame. Unvoiced speech may include consonant sounds. Transient speech frames may include transitions between voiced and unvoiced speech. Frames that are classified as neither voiced nor unvoiced speech may be classified as transient speech.

Classifying the frames as either speech or non-speech may allow different encoding modes 624, 626, 628 to be used to encode different types of frames, resulting in more efficient use of bandwidth in a shared channel, such as the communication channel 606.

The mode classification module 622 may select an encoding mode 624, 626, 628 for the current frame based upon the classification of the frame. The various encoding modes 624, 626, 628 may be coupled in parallel. One or more of the encoding modes 624, 626, 628 may be operational at any given time. In one configuration, one encoding mode 624, 626, 628 is selected according to the classification of the current frame.

The different encoding modes 624, 626, 628 may operate according to different coding bit rates, different coding schemes, or different combinations of coding bit rate and coding scheme. The different encoding modes 624, 626, 628 may also apply a different window function to a frame. The various coding rates used may be full rate, half rate, quarter rate, and/or eighth rate. The various coding modes 624, 626, 628 used may be MDCT coding, code excited linear prediction (CELP) coding, prototype pitch period (PPP) coding (or waveform interpolation (WI) coding), and/or noise excited linear prediction (NELP) coding. Thus, for example, a particular encoding mode 624, 626, 628 may be MDCT coding scheme, another encoding mode may be full rate CELP, another encoding mode 624, 626, 628 may be half rate CELP, another encoding mode 624, 626, 628 may be full rate PPP, and another encoding mode 624, 626, 628 may be NELP.

In accordance with an MDCT coding scheme that uses a traditional window to encode, transmit, receive and reconstruct at the decoder M samples of an audio signal, the MDCT coding scheme utilizes 2M samples of the input signal at the encoder. In other words, in addition to M samples of the present frame of the audio signal, the encoder may wait for an additional M samples to be collected before the encoding may begin. In a multimode coding system where the MDCT coding scheme co-exists with other coding modes such as CELP, the use of traditional window formats for the MDCT calculation may affect the overall frame size and look ahead lengths of the entire coding system. The present systems and methods provide the design and selection of window formats for MDCT calculations for any given frame size and look ahead length so that the MDCT coding scheme does not pose constraints on the multimode coding system.

In accordance with a CELP encoding mode a linear predictive vocal tract model may be excited with a quantized version of the LP residual signal. In CELP encoding mode, the current frame may be quantized. The CELP encoding mode may be used to encode frames classified as transient speech.

In accordance with a NELP encoding mode a filtered, pseudo-random noise signal may be used to model the LP residual signal. The NELP encoding mode may be a relatively simple technique that achieves a low bit rate. The NELP encoding mode may be used to encode frames classified as unvoiced speech.

In accordance with a PPP encoding mode a subset of the pitch periods within each frame may be encoded. The remaining periods of the speech signal may be reconstructed by interpolating between these prototype periods. In a time-domain implementation of PPP coding, a first set of parameters may be calculated that describes how to modify a previous prototype period to approximate the current prototype period. One or more codevectors may be selected which, when summed, approximate the difference between the current prototype period and the modified previous prototype period. A second set of parameters describes these selected codevectors. In a frequency-domain implementation of PPP coding, a set of parameters may be calculated to describe amplitude and phase spectra of the prototype. In accordance with the implementation of PPP coding, the decoder 604 may synthesize an output audio signal 616 by reconstructing a current prototype based upon the sets of parameters describing the amplitude and phase. The speech signal may be interpolated over the region between the current reconstructed prototype period and a previous reconstructed prototype period. The prototype may include a portion of the current frame that will be linearly interpolated with prototypes from previous frames that were similarly positioned within the frame in order to reconstruct the audio signal 610 or the LP residual signal at the decoder 604 (i.e., a past prototype period is used as a predictor of the current prototype period).

Coding the prototype period rather than the entire frame may reduce the coding bit rate. Frames classified as voiced speech may be coded with a PPP encoding mode. By exploiting the periodicity of the voiced speech, the PPP encoding mode may achieve a lower bit rate than the CELP encoding mode.

The selected encoding mode 624, 626, 628 may be coupled to the packet formatting module 630. The selected encoding mode 624, 626, 628 may encode, or quantize, the current frame and provide the quantized frame parameters 612 to the packet formatting module 630. In one configuration, the quantized frame parameters are the encoded coefficients produced from the MDCT coding scheme. The packet formatting module 630 may assemble the quantized frame parameters 612 into a formatted packet 613. The packet formatting module 630 may provide the formatted packet 613 to a receiver (not shown) over a communications channel 606. The receiver may receive, demodulate, and digitize the formatted packet 613, and provide the packet 613 to the decoder 604.

In the decoder 604, the packet disassembler module 632 may receive the packet 613 from the receiver. The packet disassembler module 632 may unpack the packet 613 in order to retrieve the encoded frame. The packet disassembler module 632 may also be configured to dynamically switch between the decoding modes 634, 636, 638 on a packet-by-packet basis. The number of decoding modes 634, 636, 638 may be the same as the number of encoding modes 624, 626, 628. Each numbered encoding mode 624, 626, 628 may be associated with a respective similarly numbered decoding mode 634, 636, 638 configured to employ the same coding bit rate and coding scheme.

If the packet disassembler module 632 detects the packet 613, the packet 613 is disassembled and provided to the pertinent decoding mode 634, 636, 638. The pertinent decoding mode 634, 636, 638 may implement MDCT, CELP, PPP or NELP decoding techniques based on the frame within the packet 613. If the packet disassembler module 632 does not detect a packet, a packet loss is declared and an erasure decoder (not shown) may perform frame erasure processing. The parallel array of decoding modes 634, 636, 638 may be coupled to the frame reconstruction module 640. The frame reconstruction module 640 may reconstruct, or synthesize, the frame, outputting a synthesized frame. The synthesized frame may be combined with other synthesized frames to produce a synthesized audio signal, s(n) 616, which resembles the input audio signal, s(n) 610.

Figure 7:
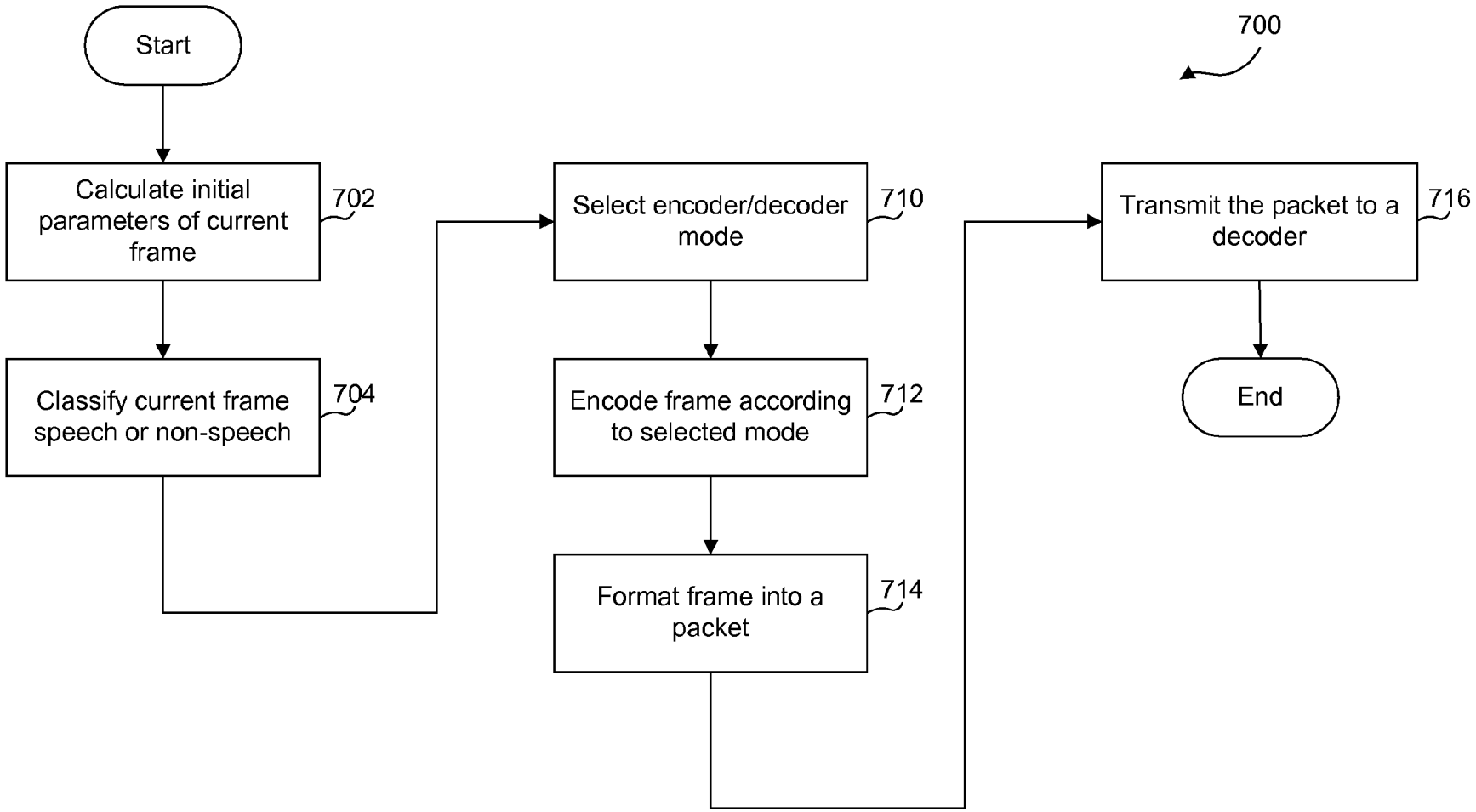
FIG. 7 is a flow diagram illustrating one example of an audio signal encoding method.

FIG. 7 is a flow diagram illustrating one example of an audio signal encoding method 700. Initial parameters of a current frame may be calculated 702. In one configuration, the initial parameter calculation module 618 calculates 702 the parameters. For non-speech frames, the parameters may include one or more coefficients to indicate the frame is a non-speech frame. Speech frames may include parameters of one or more of the following: linear predictive coding (LPC) filter coefficients, line spectral pairs (LSPs) coefficients, the normalized autocorrelation functions (NACFs), the open loop lag, band energies, the zero crossing rate, and the formant residual signal. Non-speech frames may also include parameters such as linear predictive coding (LPC) filter coefficients.

The current frame may be classified 704 as a speech frame or a non-speech frame. As previously mentioned, a speech frame may be associated with a speech signal and a non-speech frame may be associated with a non-speech signal (i.e. a music signal). An encoder/decoder mode may be selected 710 based on the frame classification made in steps 702 and 704. The various encoder/decoder modes may be connected in parallel, as shown in FIG. 6. The different encoder/decoder modes operate according to different coding schemes. Certain modes may be more effective at coding portions of the audio signal s(n) 610 exhibiting certain properties.

As previously explained, the MDCT coding scheme may be chosen to code frames classified as non-speech frames, such as music. The CELP mode may be chosen to code frames classified as transient speech. The PPP mode may be chosen to code frames classified as voiced speech. The NELP mode may be chosen to code frames classified as unvoiced speech. The same coding technique may frequently be operated at different bit rates, with varying levels of performance. The different encoder/decoder modes in FIG. 6 may represent different coding techniques, or the same coding technique operating at different bit rates, or combinations of the above. The selected encoder mode 710 may apply an appropriate window function to the frame. For example, a specific MDCT window function of the present systems and methods may be applied if the selected encoding mode is an MDCT coding scheme. Alternatively, a window function associated with a CELP coding scheme may be applied to the frame if the selected encoding mode is a CELP coding scheme. The selected encoder mode may encode 712 the current frame and format 714 the encoded frame into a packet. The packet may be transmitted 716 to a decoder.

Figure 8:
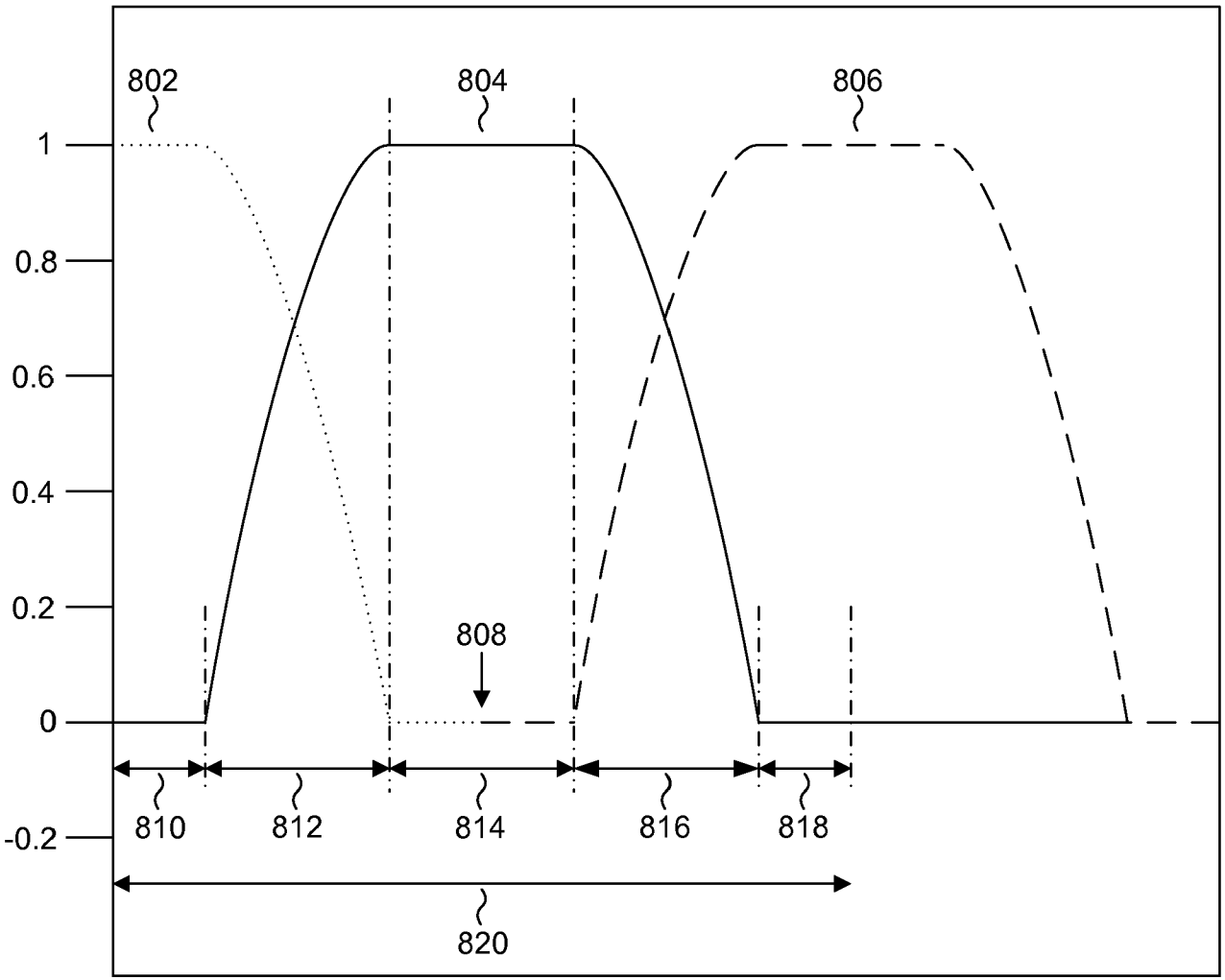
FIG. 8 is a block diagram illustrating one configuration of a plurality of frames after a window function has been applied to each frame.

FIG. 8 is a block diagram illustrating one configuration of a plurality of frames 802, 804, 806 after a specific MDCT window function has been applied to each frame. In one configuration, a previous frame 802, a current frame 804 and a future frame 806 may each be classified as non-speech frames. The length 820 of the current frame 804 may be represented by 2M. The lengths of the previous frame 802 and the future frame 806 may also be 2M. The current frame 804 may include a first zero pad region 810 and a second zero pad region 818. In other words, the values of the coefficients in the first and second zero-pad regions 810, 818 may be zero.

In one configuration, the current frame 804 also includes an overlap length 812 and a look-ahead length 816. The overlap and look-ahead lengths 812, 816 may be represented as L. The overlap length 812 may overlap the previous frame 802 look-ahead length. In one configuration, the value L is less than the value M. In another configuration, the value L is equal to the value M. The current frame may also include a unity length 814 in which each value of the frame in this length 814 is unity. As illustrated, the future frame 806 may begin at a halfway point 808 of the current frame 804. In other words, the future frame 806 may begin at a length M of the current frame 804. Similarly, the previous frame 802 may end at the halfway point 808 of the current frame 804. As such, there exists a 50% overlap of the previous frame 802 and the future frame 806 on the current frame 804.

The specific MDCT window function may facilitate a perfect reconstruction of an audio signal at a decoder if the quantizer/MDCT coefficient module faithfully reconstructs the MDCT coefficients at the decoder. In one configuration, the quantizer/MDCT coefficient encoding module may not faithfully reconstruct the MDCT coefficients at the decoder. In this case, reconstruction fidelity of the decoder may depend on the ability of the quantizer/MDCT coefficient encoding module to reconstruct the coefficients faithfully. Applying the MDCT window to a current frame may provide perfect reconstruction of the current frame if it is overlapped by 50% by both a previous frame and a future frame. In addition, the MDCT window may provide perfect reconstruction if a Princen-Bradley condition is satisfied. As previously mentioned, the Princen-Bradley condition may be expressed as:

$$w^2(n)+w^2(n+M)=1 \tag{3}$$

where w(n) may represent the MDCT window illustrated in FIG. 8. The condition expressed by equation (3) may imply that a point on a frame 802, 804, 806 added to a corresponding point on different frame 802, 804, 806 will provide a value of unity. For example, a point of the previous frame 802 in the halfway length 808 added to a corresponding point of the current frame 804 in the halfway length 808 yields a value of unity.

Figure 9:
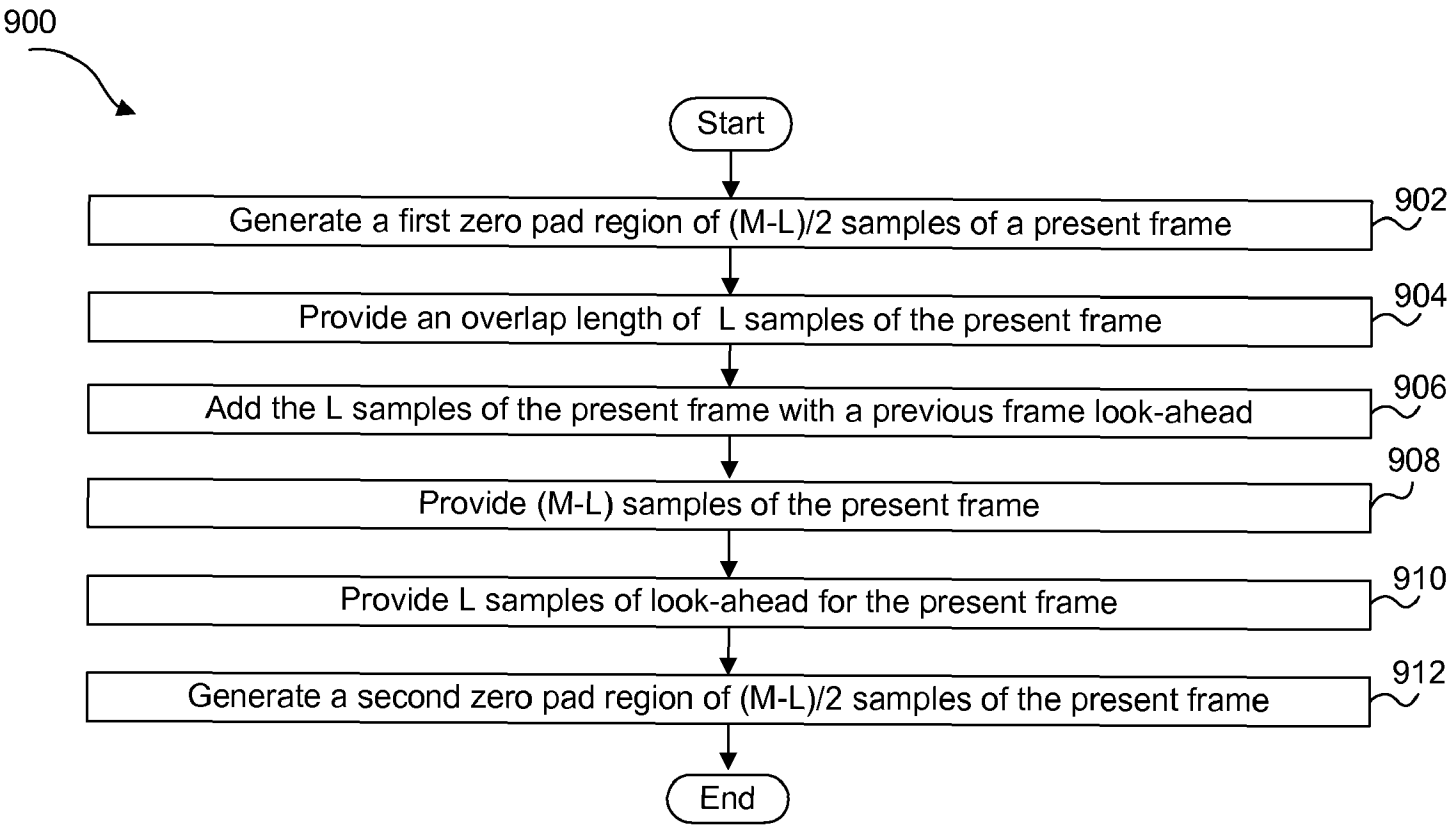
FIG. 9 is a flow diagram illustrating one configuration of a method for applying a window function to a frame associated with a non-speech signal.

FIG. 9 is a flow diagram illustrating one configuration of a method 900 for applying an MDCT window function to a frame associated with a non-speech signal, such as the present frame 804 described in FIG. 8. The process of applying the MDCT window function may be a step in calculating an MDCT. In other words, a perfect reconstruction MDCT may not be applied without using a window that satisfies the conditions of an overlap of 50% between two consecutive windows and the Princen-Bradley condition previously explained. The window function described in the method 900 may be implemented as a part of applying the MDCT function to a frame. In one example, M samples from the present frame 804 may be available as well as L look-ahead samples. L may be an arbitrary value.

A first zero pad region of (M−L)/2 samples of the present frame 804 may be generated 902. As previously explained, a zero pad may imply that the coefficients of the samples in the first zero pad region 810 may be zero. In one configuration, an overlap length of L samples of the present frame 804 may be provided 904. The overlap length of L samples of the present frame may be overlapped and added 906 with the previous frame 802 reconstructed look-ahead length. The first zero pad region and the overlap length of the present frame 804 may overlap the previous frame 802 by 50%. In one configuration, (M−L) samples of the present frame may be provided 908. L samples of look-ahead for the present frame may also be provided 910. The L samples of look-ahead may overlap the future frame 806. A second zero pad region of (M−L)/2 samples of the present frame may be generated. In one configuration, the L samples of look-ahead and the second zero pad region of the present frame 804 may overlap the future frame 806 by 50%. A frame which has been applied the method 900 may satisfy the Princen-Bradley condition as previously described.

Figure 10:
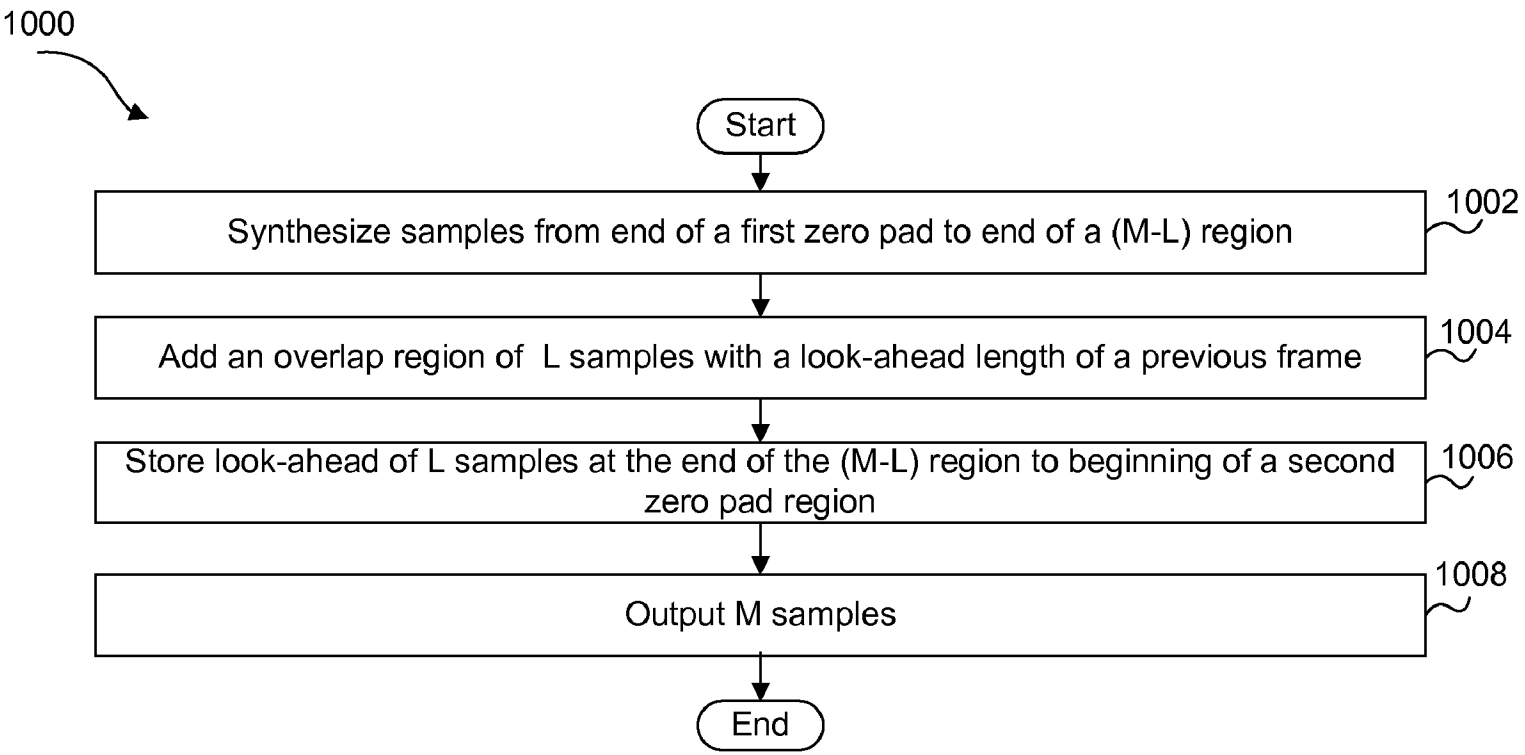
FIG. 10 is a flow diagram illustrating one configuration of a method for reconstructing a frame that has been modified by the window function.

FIG. 10 is a flow diagram illustrating one configuration of a method 1000 for reconstructing a frame that has been modified by the MDCT window function. In one configuration, the method 1000 is implemented by the frame reconstruction module 314. Samples of the present frame 804 may be synthesized 1002 beginning at the end of a first zero pad region 812 to the end of an (M−L) region 814. An overlap region of L samples of the present frame 804 may be added 1004 with a look-ahead length of the previous frame 802. In one configuration, the look-ahead of L samples 816 of the present frame 804 may be stored 1006 beginning at the end of the (M−L) region 814 to the beginning of a second zero pad region 818. In one example, the look-ahead of L samples 816 may be stored in a memory component of the decoder 304. In one configuration, M samples may be outputted 1008. The outputted M samples may be combined with additional samples to reconstruct the present frame 804.

Figure 11:
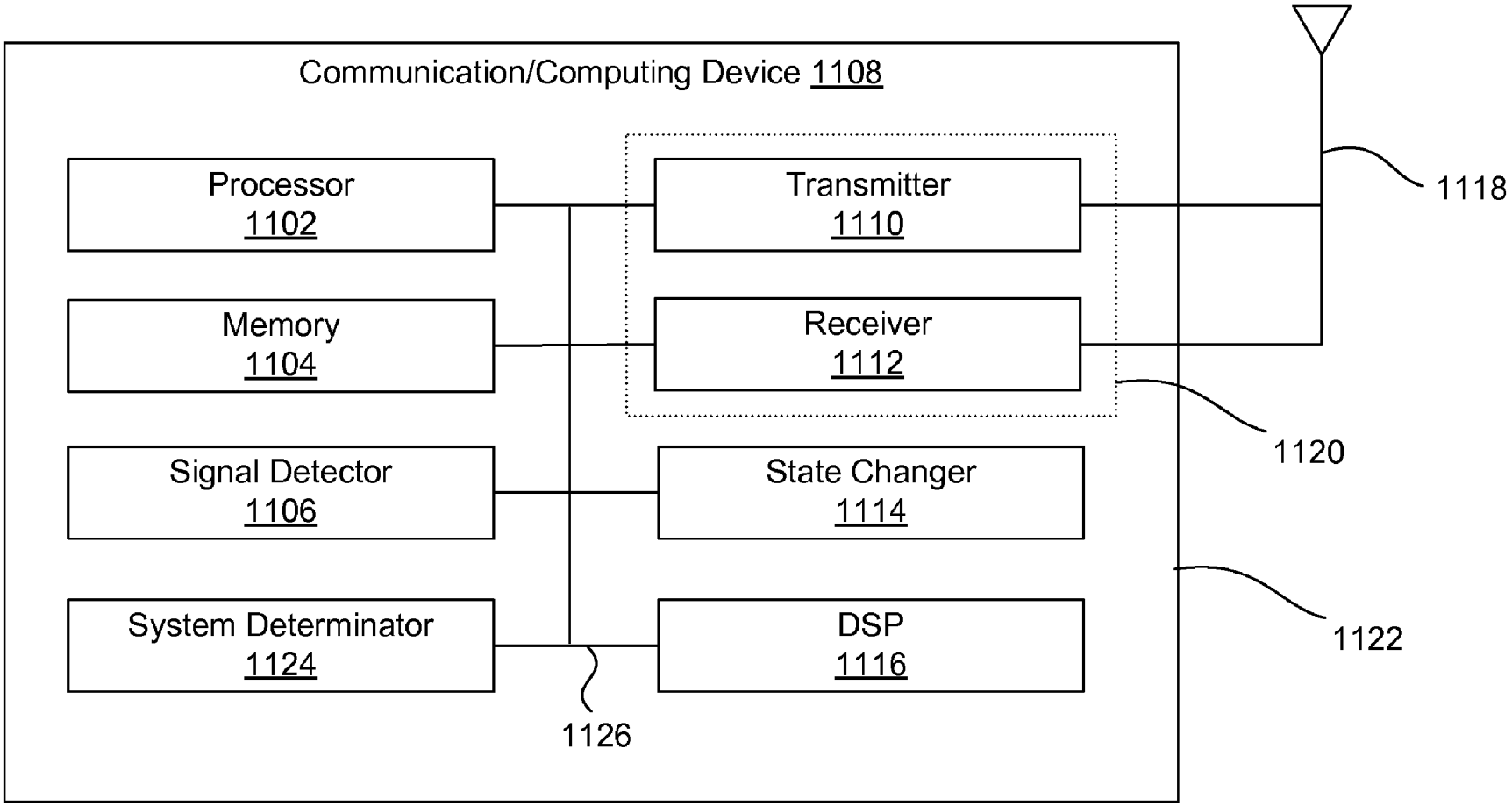
FIG. 11 is a block diagram of certain components in one configuration of a communication/computing device.

FIG. 11 illustrates various components that may be utilized in a communication/computing device 1108 in accordance with the systems and methods described herein. The communication/computing device 1108 may include a processor 1102 which controls operation of the device 1108. The processor 1102 may also be referred to as a CPU. Memory 1104, which may include both read-only memory (ROM) and random access memory (RAM), provides instructions and data to the processor 1102. A portion of the memory 1104 may also include non-volatile random access memory (NVRAM).

The device 1108 may also include a housing 1122 that contains a transmitter 1110 and a receiver 1112 to allow transmission and reception of data between the access terminal 1108 and a remote location. The transmitter 1110 and receiver 1112 may be combined into a transceiver 1120. An antenna 1118 is attached to the housing 1122 and electrically coupled to the transceiver 1120. The transmitter 1110, receiver 1112, transceiver 1120, and antenna 1118 may be used in a communications device 1108 configuration.

The device 1108 also includes a signal detector 1106 used to detect and quantify the level of signals received by the transceiver 1120. The signal detector 1106 detects such signals as total energy, pilot energy per pseudonoise (PN) chips, power spectral density, and other signals.

A state changer 1114 of the communications device 1108 controls the state of the communication/computing device 1108 based on a current state and additional signals received by the transceiver 1120 and detected by the signal detector 1106. The device 1108 may be capable of operating in any one of a number of states.

The communication/computing device 1108 also includes a system determinator 1124 used to control the device 1108 and determine which service provider system the device 1108 should transfer to when it determines the current service provider system is inadequate.

The various components of the communication/computing device 1108 are coupled together by a bus system 1126 which may include a power bus, a control signal bus, and a status signal bus in addition to a data bus. However, for the sake of clarity, the various busses are illustrated in FIG. 11 as the bus system 1126. The communication/computing device 1108 may also include a digital signal processor (DSP) 1116 for use in processing signals.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The various illustrative logical blocks, modules, circuits, and algorithm steps described in connection with the configurations disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present systems and methods.

The various illustrative logical blocks, modules, and circuits described in connection with the configurations disclosed herein may be implemented or performed with a general purpose processor, a digital signal processor (DSP), an application specific integrated circuit (ASIC), a field programmable gate array signal (FPGA) or other programmable logic device, discrete gate or transistor logic, discrete hardware components, or any combination thereof designed to perform the functions described herein. A general purpose processor may be a microprocessor, but in the alternative, the processor may be any processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the configurations disclosed herein may be embodied directly in hardware, in a software module executed by a processor, or in a combination of the two. A software module may reside in RAM memory, flash memory, ROM memory, erasable programmable read-only memory (EPROM), electrically erasable programmable read-only memory (EEPROM), registers, hard disk, a removable disk, a compact disc read-only memory (CD-ROM), or any other form of storage medium known in the art. A storage medium may be coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

The methods disclosed herein comprise one or more steps or actions for achieving the described method. The method steps and/or actions may be interchanged with one another without departing from the scope of the present systems and methods. In other words, unless a specific order of steps or actions is specified for proper operation of the configuration, the order and/or use of specific steps and/or actions may be modified without departing from the scope of the present systems and methods. The methods disclosed herein may be implemented in hardware, software or both. Examples of hardware and memory may include RAM, ROM, EPROM, EEPROM, flash memory, optical disk, registers, hard disk, a removable disk, a CD-ROM or any other types of hardware and memory.

While specific configurations and applications of the present systems and methods have been illustrated and described, it is to be understood that the systems and methods are not limited to the precise configuration and components disclosed herein. Various modifications, changes, and variations which will be apparent to those skilled in the art may be made in the arrangement, operation, and details of the methods and systems disclosed herein without departing from the spirit and scope of the claimed systems and methods.

What is claimed is:

1. A method of modifying a window with a frame associated with an audio signal, the method comprising:

Partitioning the signal into a plurality of frames;

when the plurality of frames is associated with a non-speech signal, applying a modified discrete cosine transform (MDCT) window function to each of the plurality of frames to generate a plurality of windowed frames, wherein each windowed frame includes a first zero pad region that is located at a first portion of the windowed frame, wherein the first zero pad region has a length of (M−L)/2 where L is an arbitrary value that is less than or equal to M, and 2M is a number of samples in each windowed frame.

2. The method of claim 1, further comprising encoding each of the plurality of windowed frames by applying an MDCT coding based scheme to each sample of each windowed frame of the plurality of windowed frames, wherein the windowed frames are consecutively adjacent.

3. The method of claim 1, wherein each windowed frame comprises a length of 2M.

4. The method of claim 1, wherein each windowed frame includes a second zero pad region, wherein the second zero pad region of each windowed frame is located at a second portion of the windowed frame.

5. The method of claim 4, wherein the second zero pad region of each windowed frame has a second zero pad length of (M−L)/2.

6. The method of claim 5, further comprising including a present overlap region of length L within each windowed frame, wherein the present overlap region of a particular windowed frame overlaps look-ahead samples associated with a previous windowed frame.

7. The method of claim 6, further comprising adding a sample associated with the present overlap region of the particular windowed frame to a corresponding look-ahead sample associated with the previous windowed frame.

8. The method of claim 4, wherein L is a look-ahead region that is less than M.

9. The method of claim 8, wherein the look-ahead region overlaps a future overlap region associated with a future windowed frame.

10. The method of claim 6, wherein the first zero pad region and the present overlap region overlap a previous windowed frame by approximately 50%.

11. The method of claim 8, wherein the second zero pad region and the look-ahead region overlap a future windowed frame by approximately 50%.

12. The method of claim 1, wherein a sum of squares of each sample of a first windowed frame added with an associated sample from an overlapped windowed frame equals unity.

13. An apparatus for modifying a window with a frame associated with an audio signal comprising:

a processor;

memory in electronic communication with the processor; and instructions stored in the memory, the instructions being executable to:

partition a signal into a plurality of frames; and when the plurality of frames is associated with a non-speech signal, apply a modified discrete cosine transform (MDCT) window function to each frame of the plurality of frames to generate a plurality of windowed frames, wherein each windowed frame includes a first zero pad region that is located at a first portion of the windowed frame, wherein the first zero pad region has a length of (M−L)/2, where L is an arbitrary value that is less than or equal to M and 2M is a number of samples in each windowed frame.

14. The apparatus of claim 13, wherein the instructions are further executable to encode each of the plurality of windowed frames using an MDCT coding based scheme, wherein the windowed frames are consecutively adjacent.

15. The apparatus of claim 13, wherein each windowed frame comprises a length of samples equal to 2M.

16. The apparatus of claim 13, wherein each windowed frame includes a second zero pad region, wherein the second zero pad region is located at a second portion of the windowed frame.

17. A system that is configured to modify a window with a frame associated with an audio signal comprising:

means for processing;

means for partitioning a signal into a plurality of frames;

means for applying a modified discrete cosine transform (MDCT) window function to each frame of the plurality of frames when the plurality of frames is associated with a non-speech signal to generate a plurality of windowed frames that are consecutively adjacent, wherein each windowed frame includes a first zero pad region that is located at a first portion of the windowed frame, wherein the first zero pad region has a length of (M−L)/2, where L is an arbitrary value that is less than or equal to M and 2M is a number of samples in each windowed frame; and means for encoding each of the plurality of windowed frames using an MDCT coding based scheme.

18. A computer-readable medium configured to store a set of instructions executable to:

partition a signal into a plurality of frames;

when the plurality of frames is associated with a non-speech signal, apply a modified discrete cosine transform (MDCT) window function to each frame of the plurality of frames to generate a plurality of windowed frames that are consecutively adjacent, wherein each windowed frame includes a first zero pad region that is located at a first portion of the windowed frame, wherein the first zero pad region has a length of (M−L)/2, where L is an arbitrary value that is less than or equal to M and 2M is a number of samples in each windowed frame; and encode each of the plurality of windowed frames using an MDCT coding based scheme.

19. A method for selecting a window function to be used in calculating a modified discrete cosine transform (MDCT) of a frame, the method comprising:

providing an algorithm to select a window function;

applying the selected window function to each of a plurality of non-speech frames to produce a plurality of windowed frames, wherein the windowed frames are consecutively adjacent and each windowed frame includes a first zero pad region that is located at a first portion of the windowed frame, wherein the first zero pad region has a length of (M−L)/2, where L is an arbitrary value that is less than or equal to M and 2M is a number of samples in each windowed frame; and encoding each of the plurality of windowed frames with a modified discrete cosine transform (MDCT) coding mode based on constraints imposed on the MDCT coding mode, wherein the constraints comprise a length of the frame, a look ahead length and a delay.

20. A method comprising:

when a portion of an audio signal is classified as speech:

encoding a frame of the portion of the audio signal according to a first encoding scheme when the frame is classified as voiced speech; and encoding the frame of the portion of the audio signal according to a second encoding scheme when the frame is classified as unvoiced speech, wherein the second encoding scheme differs from the first encoding scheme;

when the portion of the audio signal is classified as non-speech and the portion of the audio signal includes a current frame, a previous frame, and a subsequent frame that are consecutively adjacent frames:

applying a modified discrete cosine transform (MDCT) window function to each of the current frame, the previous frame, and the subsequent frame to produce a plurality of windowed frames including a windowed current frame, a windowed previous frame, and a windowed subsequent frame, wherein each windowed frame includes a first zero pad region that is located at a first portion of the windowed frame, wherein the first zero pad region has a length of (M−L)/2, where L is an arbitrary value that is less than or equal to M and 2M is a number of samples in each windowed frame.

21. The method of claim 20, wherein the windowed current frame has a 50% overlap with the windowed previous frame and a 50% overlap with the windowed subsequent frame; and encoding the current windowed frame according to a modified discrete cosine transform coding scheme.

22. The method of claim 20, further comprising encoding the frame of the portion of the audio signal according to a third encoding scheme when the portion of the audio signal is classified as transient speech, wherein the third encoding scheme differs from the first encoding scheme and from the second encoding scheme.

23. The method of claim 1, further comprising, for each of the plurality of windowed frames, encoding the windowed frame by applying an MDCT coding based scheme after receiving L samples in addition to the windowed frame samples and before receiving M samples in addition to the windowed frame samples.

* * * * *